US008454198B2

(12) United States Patent
Garrett

(10) Patent No.: US 8,454,198 B2
(45) Date of Patent: Jun. 4, 2013

(54) STRINGED LIGHTS

(76) Inventor: Christine A. Garrett, Denver, NC (US)

( * ) Notice: Subject to any disclaimer, the term of this patent is extended or adjusted under 35 U.S.C. 154(b) by 353 days.

(21) Appl. No.: 12/245,812

(22) Filed: Oct. 6, 2008

(65) Prior Publication Data

US 2009/0091266 A1 Apr. 9, 2009

Related U.S. Application Data

(60) Provisional application No. 60/977,665, filed on Oct. 5, 2007.

(51) Int. Cl.
*F21V 21/00* (2006.01)

(52) U.S. Cl.
USPC ..... 362/249.06; 362/249.03; 362/249.08; 362/249.1; 362/249.14

(58) Field of Classification Search
USPC ..... 362/249.06, 249.03, 249.08, 249.09, 362/249.1, 249.14; 248/309.1, 523, 316.7
See application file for complete search history.

(56) References Cited

U.S. PATENT DOCUMENTS

| | | | | |
|---|---|---|---|---|
| 3,789,211 | A * | 1/1974 | Kramer | 362/231 |
| 4,813,834 | A * | 3/1989 | Smith | 411/337 |
| 6,619,831 | B2 * | 9/2003 | Kanesaka | 362/555 |
| 6,908,213 | B1 * | 6/2005 | Goodman | 362/232 |
| 7,128,438 | B2 * | 10/2006 | Ratcliffe | 362/236 |
| 7,380,961 | B2 * | 6/2008 | Moriyama et al. | 362/238 |

* cited by examiner

*Primary Examiner* — Jong-Suk (James) Lee
*Assistant Examiner* — Mark Tsidulko
(74) *Attorney, Agent, or Firm* — Trego, Hines & Ladenheim, PLLC

(57) ABSTRACT

A stringed light set having a pair of conductors for supplying electricity and at least one light electrically connected to the conductors for receiving electricity and providing luminance. The at least one light being adapted to move between a use position and a storage position relative to the conductors.

6 Claims, 7 Drawing Sheets

STRINGED LIGHTS

This application claims the benefit of Provisional Application No. 60/977,665 filed on Oct. 5, 2007.

TECHNICAL FIELD AND BACKGROUND OF THE INVENTION

The present invention relates to the field of lights. In particular, the invention relates to a stringed light set, such as Christmas tree lights.

Stringed lights are well-known and are used to decorate trees, houses, and other structures during the holidays, or for providing backlighting and decoration at restaurants and other businesses. Typically, the stringed lights are made of a series of lights interconnected by a pair of conductors braided together to form the appearance of a single conductor. The lights include a socket or base connected to the conductors and a bulb that is received within the base. The base and bulb are supported primarily by the conductors in a position substantially perpendicular to the conductors.

During use, the stringed lights are laid out lengthwise such that the lights form a series of lights positioned linearly along the length of the conductors. The stringed lights are then positioned around a tree or along a structure to provide the desired lighting effect. When finished, the lights are typically stored by wrapping them around a cylindrical object or by placing them back into the original packaging.

Unfortunately, when working with the stringed lights or when removing the stringed lights from storage, they can become tangled due to the lights interfering with the conductors or with other lights. This is due to the fact that the lights naturally lay substantially perpendicular to the conductors, thereby causing a plurality of lights to stick up.

SUMMARY OF THE INVENTION

These and other shortcomings of the prior art are addressed by the present invention, which provides a stringed light set that can be easily worked with, stored, or removed from storage without tangling.

According to one aspect of the present invention, a stringed light set includes a pair of conductors for supplying electricity and at least one light electrically connected to the conductors for receiving electricity and providing luminance, wherein the at least one light is adapted to move between a use position and a storage position relative to the conductors.

According to another aspect of the invention, a stringed light set includes a pair of spaced-apart conductors for supplying electricity, a plurality of lights electrically connected to and positioned between the conductors in spaced-apart relation along the length thereof, and a plurality of pins. Each of the plurality of lights includes a base and a bulb. Each of the plurality of pins are adapted to pivotally support a respective one of the plurality of lights such that each of the plurality of lights are moveable between an upright use position and a flat storage position.

According to another aspect of the invention, a stringed light set includes a plurality of lights electrically connected to and positioned between a pair of spaced-apart conductors, a plurality of pins, and an actuator. Each of the plurality of lights includes a bulb supported by a base. Each of the plurality of pins are adapted to pivotally support a respective one of the plurality of lights such that each of the plurality of lights are moveable between an upright use position and a flat storage position. Each of the plurality of pins extends through a respective base of each of the plurality of lights to allow the plurality of lights to rotate thereabout. The actuator is connected to each of the plurality of lights such that movement of the actuator causes each of the plurality of lights to move between the use position and the storage position.

BRIEF DESCRIPTION OF THE DRAWINGS

The invention may be best understood by reference to the following description in conjunction with the accompanying drawing figures in which.

DESCRIPTION OF THE PREFERRED EMBODIMENT AND BEST MODE

Figure 1:
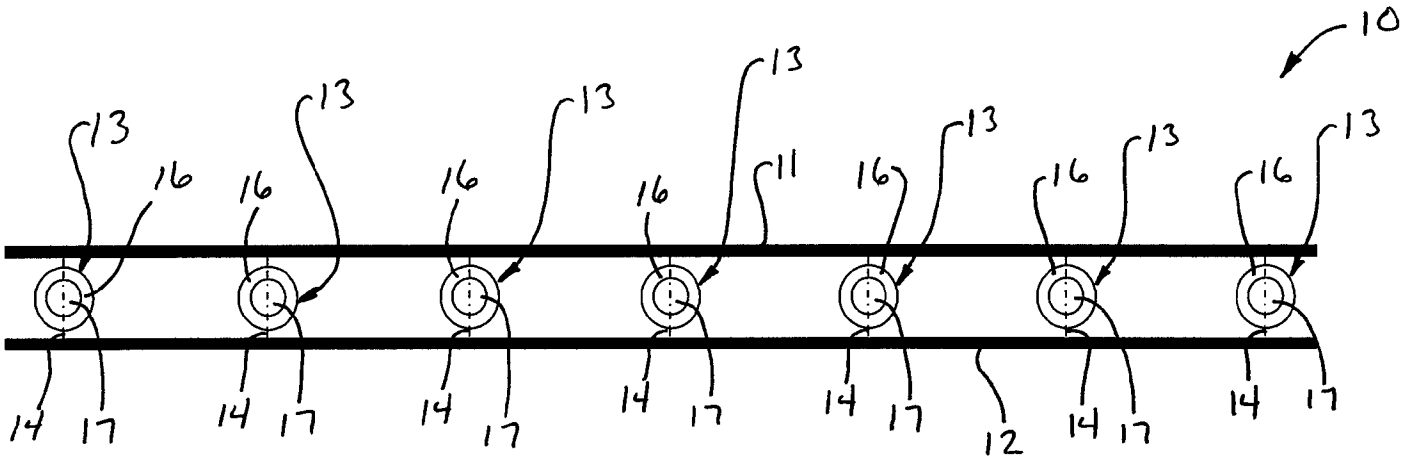
FIG. 1 is a plan view of a set of stringed lights according to an embodiment of the invention.

Referring now specifically to the drawings, a stringed light set according to an embodiment of the invention is illustrated in FIGS. 1-4 and shown generally at reference numeral 10. The stringed lights include a pair of spaced-apart conductors 11 and 12, a plurality of lights 13 positioned between the conductors 11 and 12 and supported by pins 14 extending between the conductors 11 and 12. Each of the pins 14 pivotally supports a respective one of the lights 13.

Figure 2:
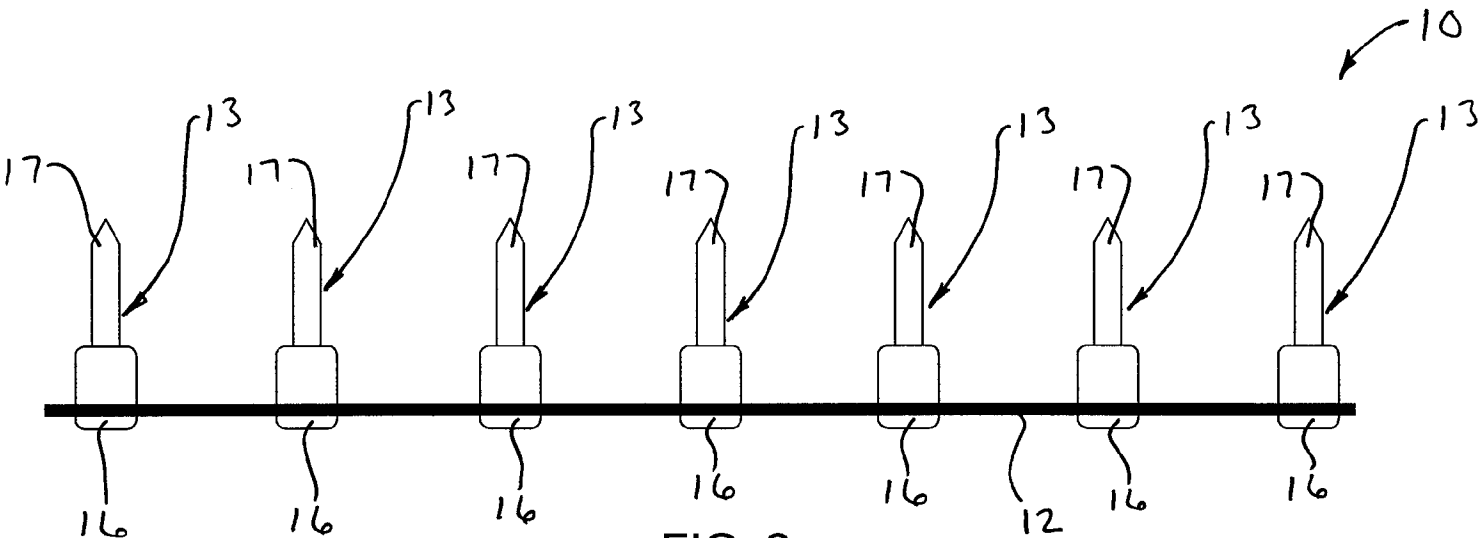
FIG. 2 is a side view of the stringed lights of FIG. 1.
Figure 3:
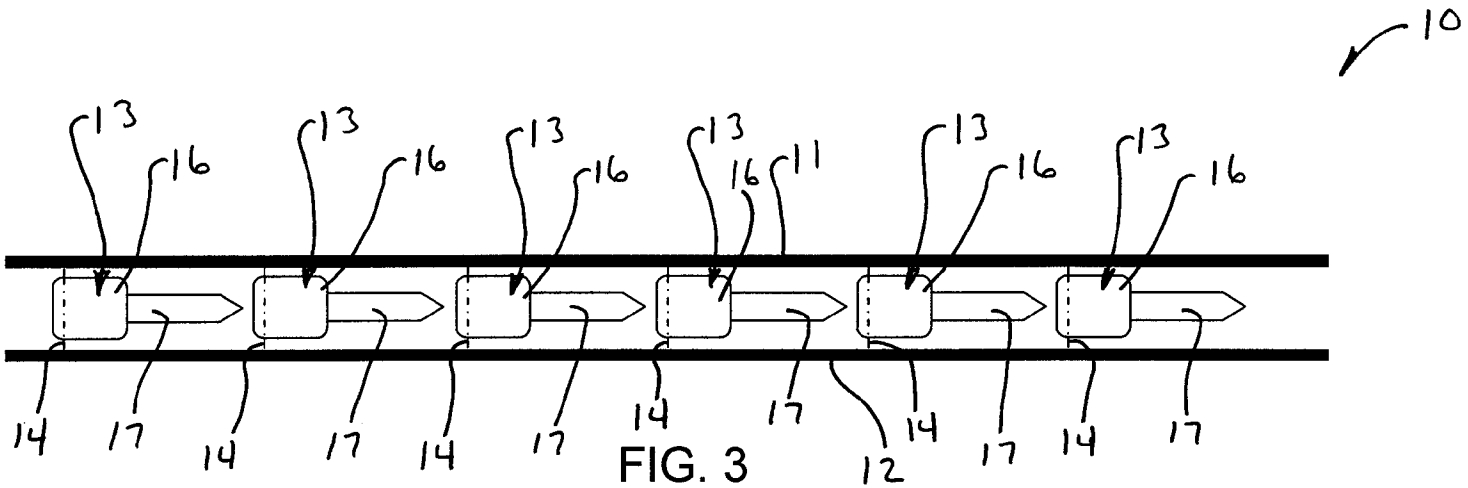
FIG. 3 shows the stringed lights of FIG. 1 in a stored position.
Figure 4:
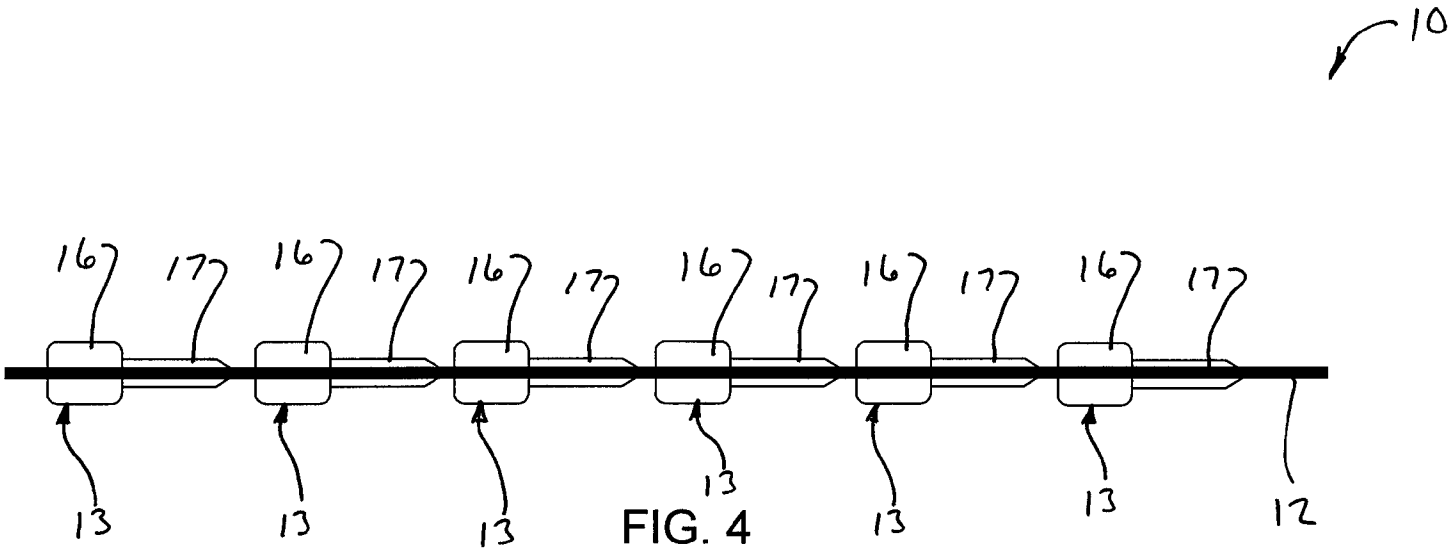
FIG. 4 is a side view of the stringed lights of FIG. 3.

The lights 13 are moveable between an upright, use position, shown in FIGS. 1 and 2, and a flat, storage position, shown in FIGS. 3 and 4, and include a base 16 and a bulb 17. As shown in FIGS. 1 and 3, each of the pins 14 extend through the base 16 of a respective one of the lights 13 and is supported at opposing ends 18 and 19 by the conductors 11 and 12. This arrangement allows the stringed lights 10 to remain flexible.

Figure 5:
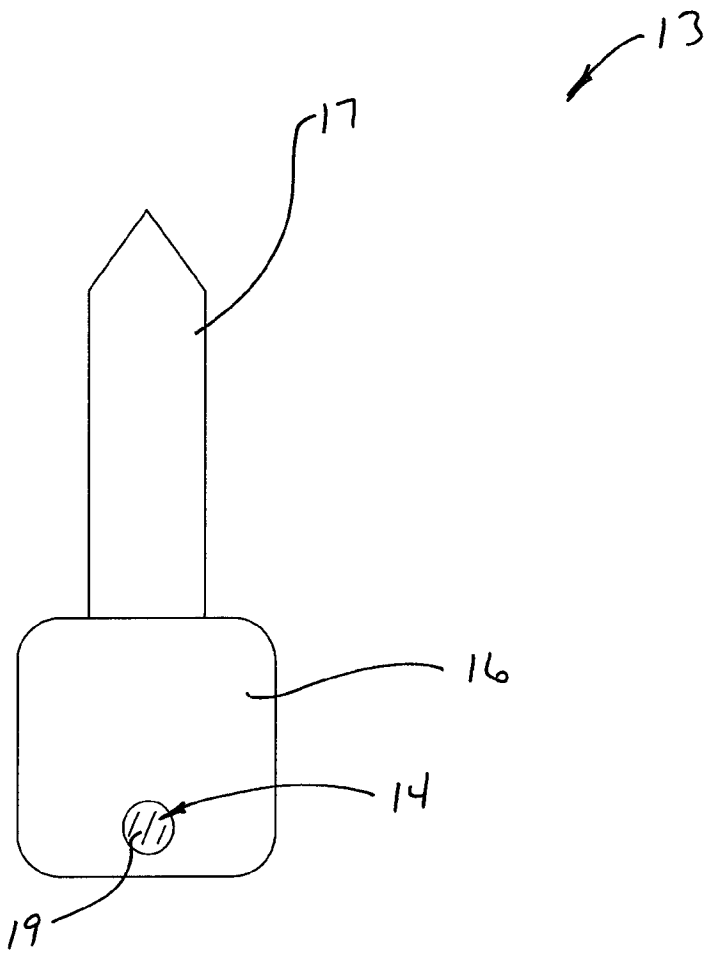
FIG. 5 is a side view of a light of the stringed lights of FIG. 1.
Figure 6:
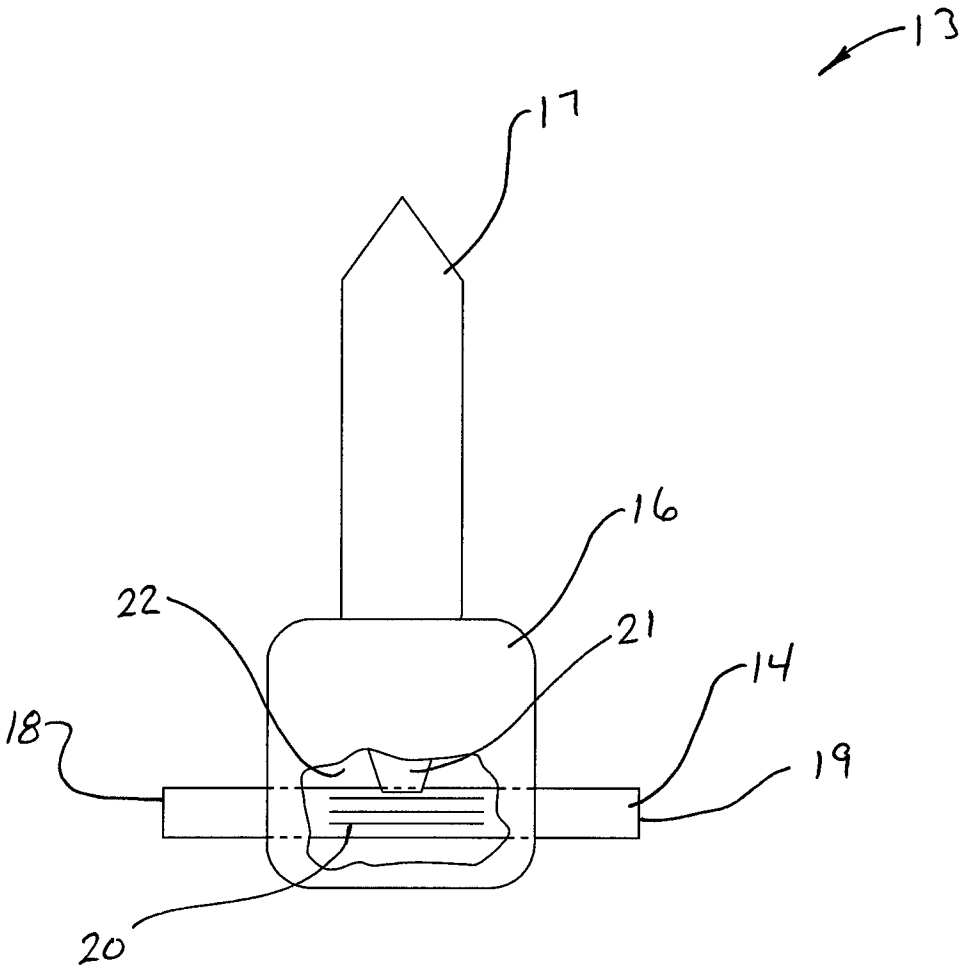
FIG. 6 shows a partial cut away of a front of the light of FIG. 5.

Referring to FIGS. 5 and 6, a pin 14 extends through a portion of the base 16 of a light 13. The pin 14 includes a plurality of spaced-apart grooves 20 disposed along the length of the pin 14 for interacting with a flexible projection, such as a locking tab 21, extending from an inside wall 22 of the base 16. The grooves 20 and tab 21 prevent the light 13 from freely rotating about the pin 14. As the light is rotated about the pin 14, the tab 21 flexes to allow the light to rotate and then extends into a corresponding groove 20 to lock the light 13 into a desired position. It should be appreciated that any suitable type of groove, serration, or hole may be used in conjunction with any suitable locking device, tab, or projection. It should also be appreciated that the projection may be positioned on the pin 14 and the grooves positioned in the base 16.

Figure 7:
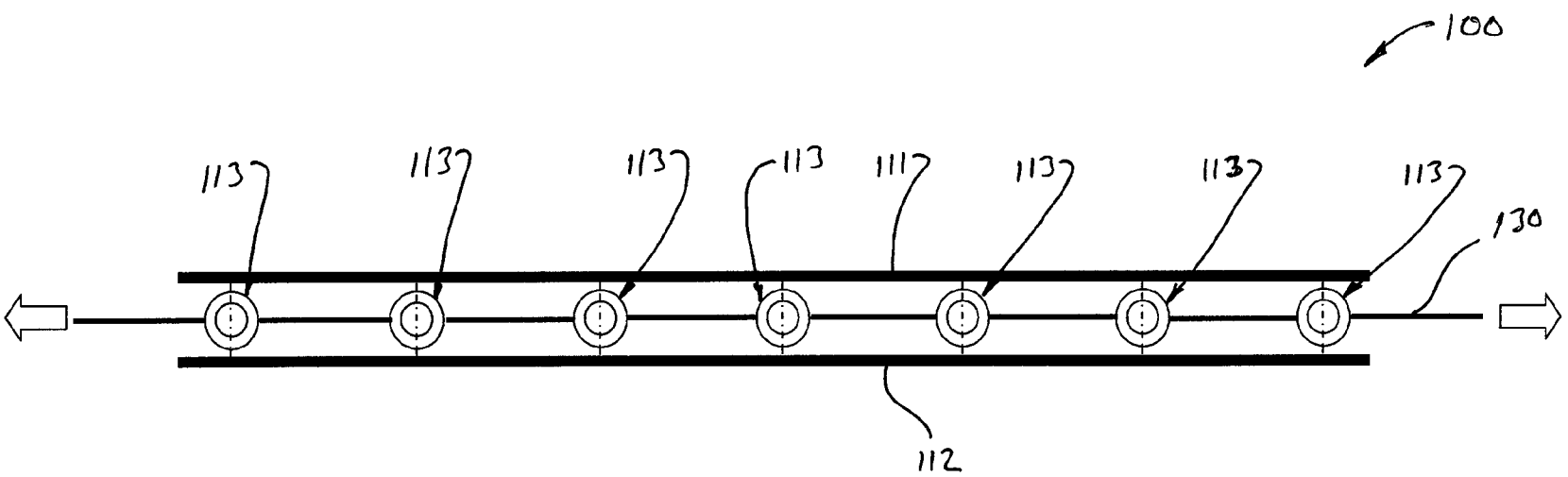
FIG. 7 is a plan view of a set of stringed lights according to an embodiment of the invention.
Figure 8:
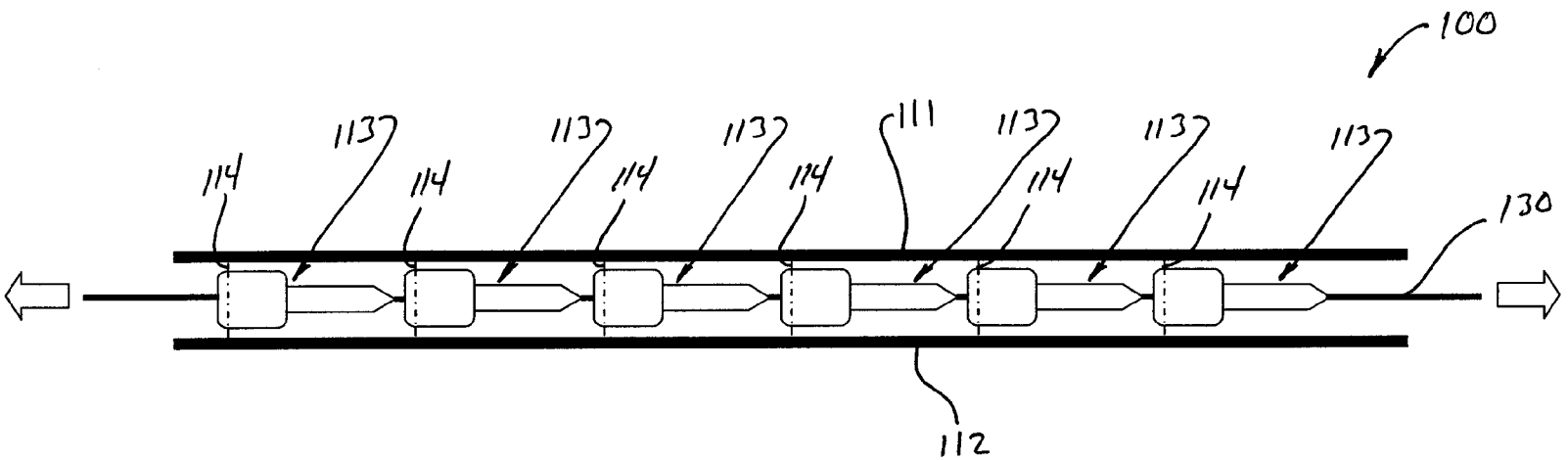
FIG. 8 shows the stringed lights of FIG. 7 in a stored position.

A stringed light set 100 according to an embodiment of the invention is shown in FIGS. 7 and 8. Like the stringed lights 10, the stringed light 100 includes a pair of spaced-apart conductors 111 and 112, a plurality of lights 113 having a base 116 and a bulb 117, and a plurality of pins 114. Unlike the stringed lights 10, the stringed lights 100 include an actuator 130 connected to each of the lights 113 for moving the lights 113 between a use position, shown in FIG. 7, and a stored position, shown in FIG. 8. The actuator 130 allows an individual to pull a respective one of the ends 131 and 132 of the actuator 130 to move the lights 113. This eliminates the need to move each light 113 individually. The actuator 130 may be any suitable device for moving the lights 113. For example, the actuator 130 may be a string, a ribbon, a flexible plastic rod, or any other suitable actuator for moving the lights 113 between a use position and a stored position.

Figure 9:
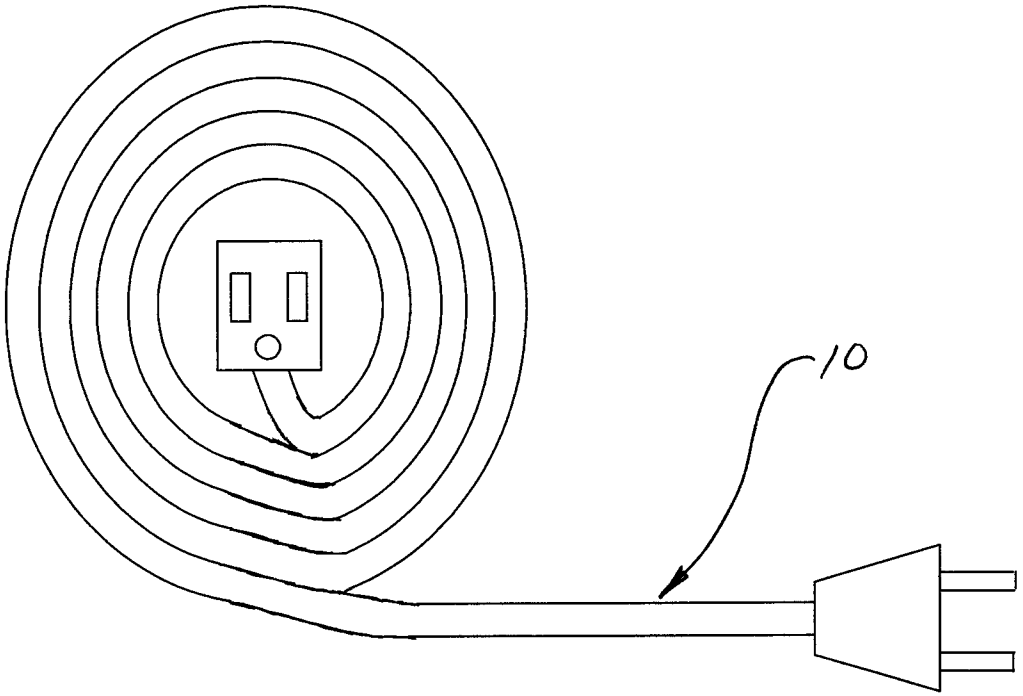
FIG. 9 shows the stringed lights of FIG. 1 rolled-up.
Figure 10:
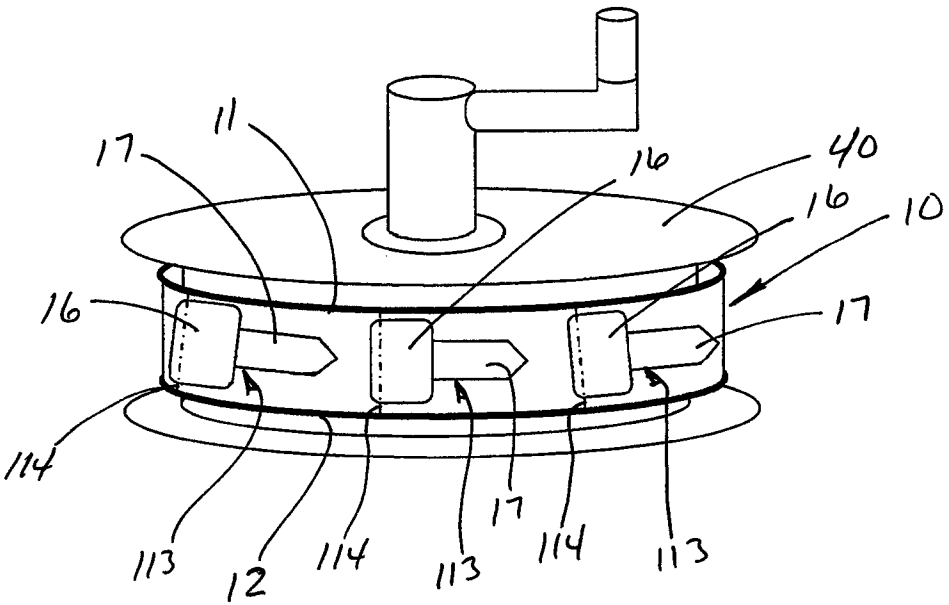
FIG. 10 shows the stringed lights of FIG. 1 rolled-up on a spool.

As shown in FIGS. 9 and 10, the stringed lights 10 or 100 may be rolled-up for storage purposes. For purposes of this discussion, this feature will only be discussed with reference to the stringed lights 10. Because of the flexibility of the stringed lights 10, the stringed lights 10 may be rolled up by hand without the aid of a cylinder, drum, or spool, shown in FIG. 9, or rolled-up on a spool 40, shown in FIG. 10. Because the lights 13 lie substantially flat, the stringed lights 10 may be rolled-up in a stacked configuration which eliminates tangling and allows for a more compact roll.

Stringed lights are described above. Various details of the invention may be changed without departing from its scope. Furthermore, the foregoing description of the preferred embodiments of the invention and best mode for practicing the invention are provided for the purpose of illustration only and not for the purpose of limitation.

I claim:

1. A stringed light set, comprising:

(a) a plurality of lights electrically connected to and positioned between a pair of spaced-apart flexible wire conductors, each of the plurality of lights including a bulb supported by a base;

(b) a plurality of pins, each of the plurality of pins being adapted to pivotally support a respective one of the plurality of lights such that each of the plurality of lights are rotatable between an upright use position and a flat storage position, wherein each of the plurality of pins extends through a respective base of each of the plurality of lights and between the wire conductors to create a pivot axis extending through the base and each of the wire conductors for the plurality of lights to rotate about;

(c) an actuator connected to each of the plurality of lights such that movement of the actuator causes each of the plurality of lights to rotate between the use position and the storage position, the actuator having first and second free ends to allow a user to pull on a respective one of the ends and cause movement of the plurality of lights.

2. The stringed light set according to claim 1, wherein each of the plurality of pins is supported by the wire conductors.

3. The stringed light set according to claim 2, wherein opposing ends of each of the plurality of pins is supported by the wire conductors.

4. The stringed light set according to claim 1, wherein:

(a) each of the plurality of pins include a plurality of spaced-apart grooves disposed along the length of the pin; and (b) each of the bases include a flexible projection extending from an inside wall of the base, wherein the projection is adapted to interact with one of the plurality of grooves, thereby locking the light in a desired position and prevent the light from rotating freely.

5. The stringed light set according to claim 4, wherein the projection flexes to allow the projection to disengage a respective groove and allow the light to rotate in increments between the use position and the storage position.

6. The stringed light set according to claim 1, wherein the actuator is selected from the group consisting of a string, a ribbon, and a flexible plastic rod.

* * * * *